United States Patent [19]

Delacour et al.

[11] Patent Number: 4,506,512

[45] Date of Patent: Mar. 26, 1985

[54] CRYOGENIC LIQUID DISTRIBUTING DEVICE

[75] Inventors: Pierre Delacour, Sassenage; Roger Prost, Saint-Egreve, both of France

[73] Assignee: L'Air Liquide, Societe Anonyme pour l'Etude et l'Exploitation des Procedes Georges Claude, Paris, France

[21] Appl. No.: 569,587

[22] Filed: Jan. 10, 1984

[30] Foreign Application Priority Data

Jan. 12, 1983 [FR] France ..... 83 00372

[51] Int. Cl.[3] ..... F17C 13/02

[52] U.S. Cl. ..... 62/49; 62/55; 137/340

[58] Field of Search ..... 62/49, 55, 129; 137/340

[56] References Cited

U.S. PATENT DOCUMENTS

| | | | |
|---|---|---|---|
| 2,500,320 | 3/1950 | Peff | 62/53 |
| 2,610,471 | 9/1952 | Thayer | 62/49 |
| 3,938,347 | 2/1976 | Riedel et al. | 62/49 |

FOREIGN PATENT DOCUMENTS 1360622 3/1964 France .

*Primary Examiner*—Ronald C. Capossela

*Attorney, Agent, or Firm*—Young & Thompson

[57] ABSTRACT

The device comprises a reservoir having a double wall 4–5 with an inlet pipe 24 having a valve 31 whose movable valve member 30 is connected to a float 35 and a drawing-off pipe 41 having a valve 45 whose valve member 50 is connected to a control rod 52. The drawing-off valve 45 is placed in the thermal insulation space of the reservoir. Application in the distribution of low and usually intermittent flows of cryogenic liquids and in particular nitrogen or argon for rendering inert pouring jets employed in metallurgy.

7 Claims, 6 Drawing Figures

CRYOGENIC LIQUID DISTRIBUTING DEVICE

The present invention relates to a device for producing cryogenic liquid and more particularly a device adapted to distribute such a liquid at a precise and low rate of flow from a reservoir of cryogenic liquid under pressure to a receiving utilization vessel which is at atmospheric pressure.

There has already been proposed a cryogenic liquid distributing device which comprises a constant-level reservoir which is highly insulated by means of a double wall defining an interstitial insulating space filled with insulating particles between an inner reservoir body and an outer case, into which reservoir open an inlet pipe and a lower drawing-off pipe, with constant-level regulating means acting on an inlet valve of the inlet pipe and means for regulating the utilization flow acting on a valve of the drawing-off pipe, which valve is thermally insulated from the exterior. In this type of device, the inlet valve performs a function of a relief valve while a degasing pipe for removing the vapours produced upon the expansion of the cryogenic liquid conveys these vapours to the surrounding atmosphere and thus maintains the production up to the interior of the reservoir at a constant value.

In applications in which there are required flows which are relatively low but variable according to the desired type of application, the device must be stable, in particular with respect to time, and there must ccorrespond to a given position of the drawing-off valve a flow of liquid which is well-determined irrespective of the exterior conditions prevailing at the moment of utilization, such as atmospheric, humidity and ambient conditions or thermal radiation, and also irrespective of the conditions prior to these utilizations, such as the previously-produced freezing, layer of ice or frost on the distribution means etc. Moreover, as in many applications flows are required which are not only low but also intermittent, the causes of disturbance mentioned hereinbefore are delicate to take into account in a simple manner and an object of the present invention is to provide a cryogenic liquid distributing device of the aforementioned type which is simple, sturdy and reliable and whose operational characteristics are constant, so as to permit the distribution of a flow of cryogenic liquid which is of low constant value, notwithstanding the fact that it is very often intermittent.

According to the invention, the thermal insulation of the drawing-off valve is ensured by the insulation proper of the reservoir by placing this valve in the insulation space between the two walls of the reservoir, the means for controlling said drawing-off valve, which is of the control rod type, extending in said interstitial insulation space and engaging in a fluidtight passageway of the outer case. Owing to this essential arrangement in which the thermal insulation valve is maintained in the insulation space in the cold state, the thermal flux which reaches the cryogenic liquid through the valve is at the maximum 5 watts (for example in the case of a pearlite insulator whose thermal conductivity is 300 $\mu$W/cm.K). Such a thermal flux only allows, for example, the evaporation of 115 cc of nitrogen per hour, namely a flow of 20 l/h in the valve, that is to say the same order of magnitude as a very low rate of flow of liquid. On the other hand, when the drawing-off valve is placed outside, the thermal flux acting on the cryogenic liquid present in the region of the valve easily reaches 50 to 100 watts, depending on the operational conditions at the time (coefficient of heat exchange in air: 1,500 to 2,000 W/m$^2$ without condensation of the air). Such a flux considerably increases the thermal losses of the distributing device, but above all it results in an intense evaporation of the liquid in the valve which considerably hinders the regulated distribution of a desired flow which may reach, for example, 0.3 l/min.

Experience has shown that, with the arrangement according to the invention, flow regulating characteristics are obtained which are perfectly reliable and which are maintained completely independently of the conditions of utilization of the device.

The features and advantages of the invention will be moreover apparent from the following description which is given by way of example with reference to the accompanying drawings, in which.

Figure 1:
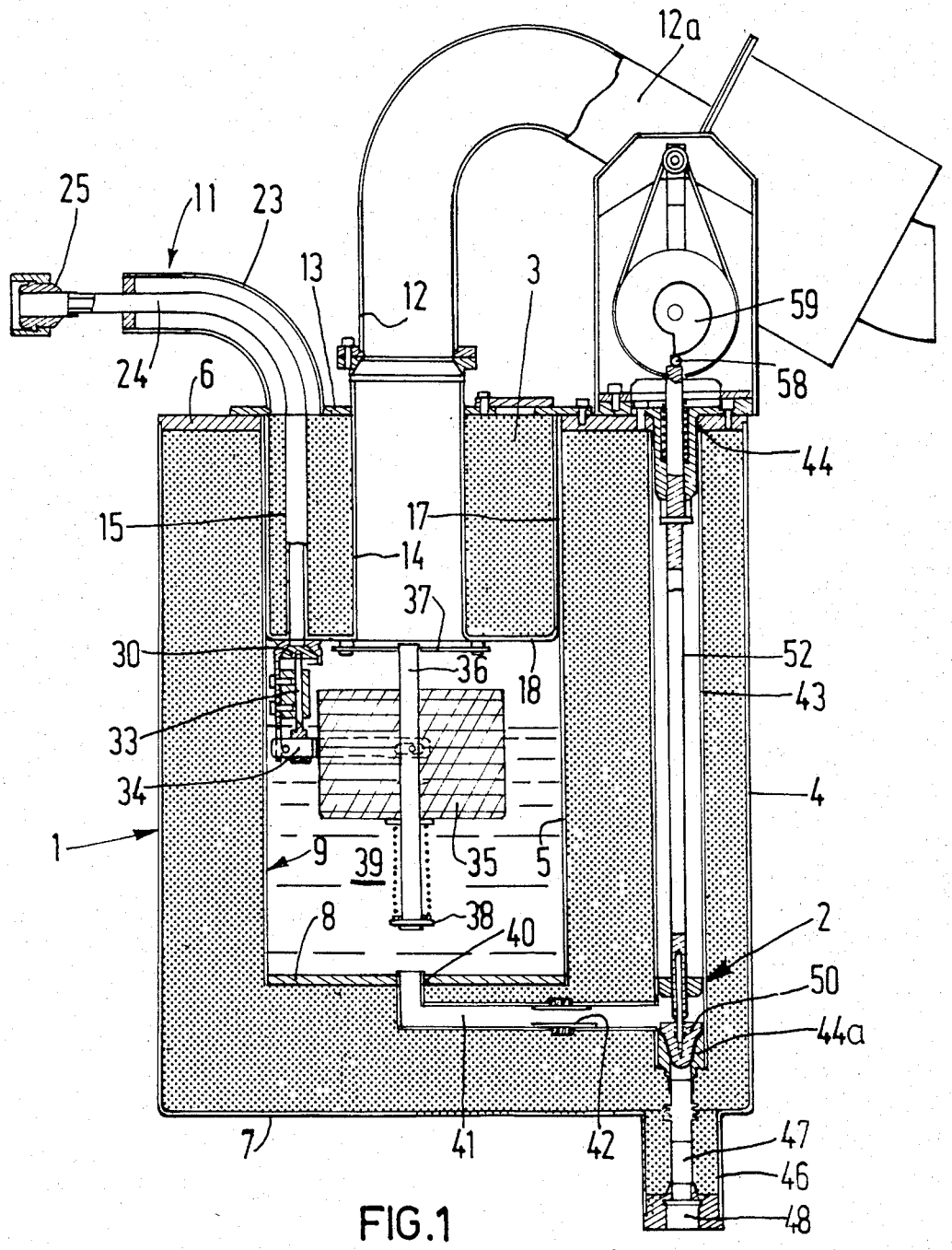
FIG. 1 is a vertical axial sectional view of a distributing device according to the invention.
Figure 2:
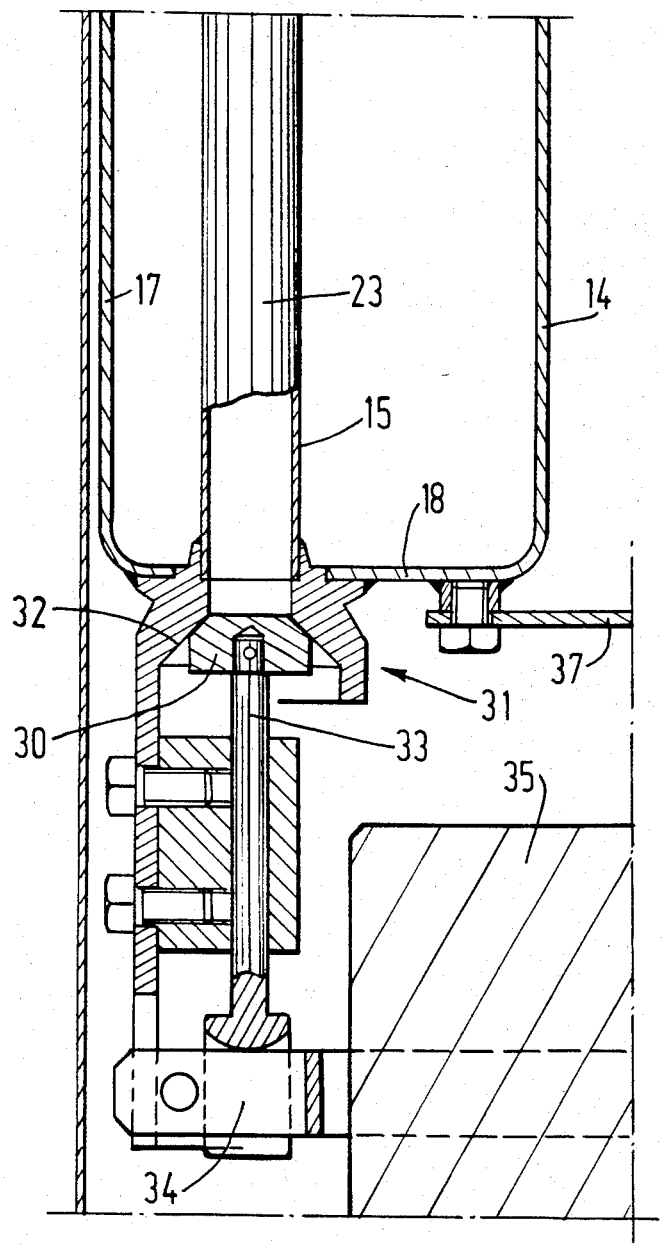
FIGS. 2 to 5 are also vertical axial sectional views of four details of FIG. 1 on an enlarged scale.
Figure 3:
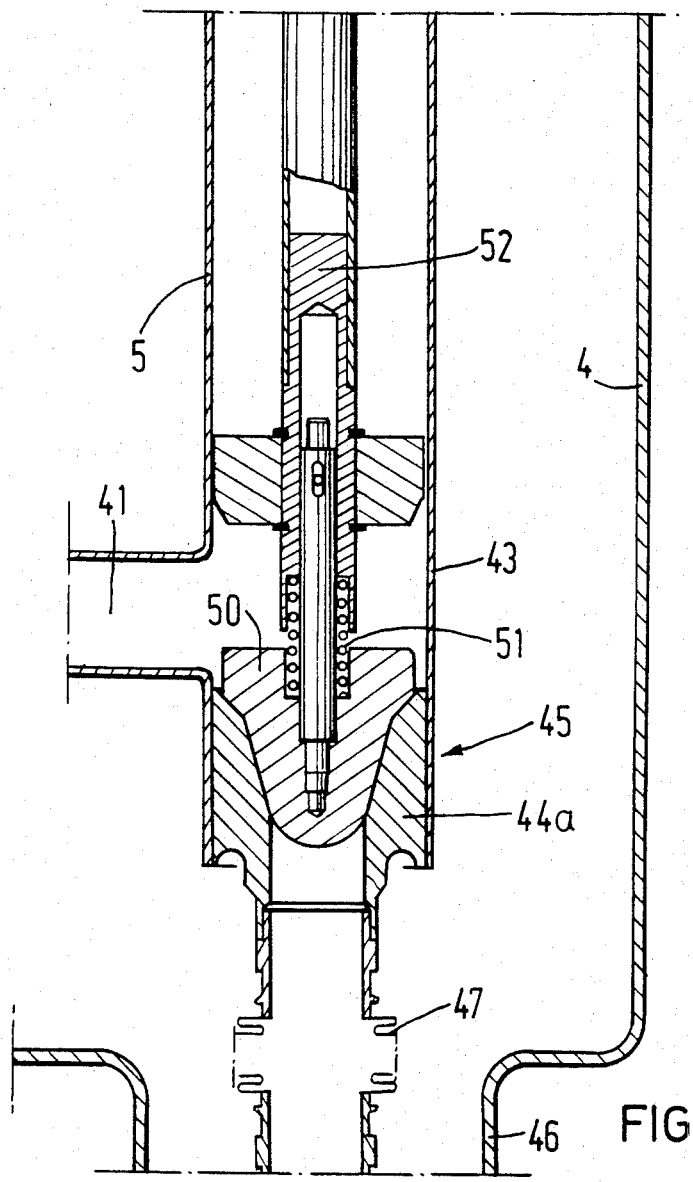
Figure 4:
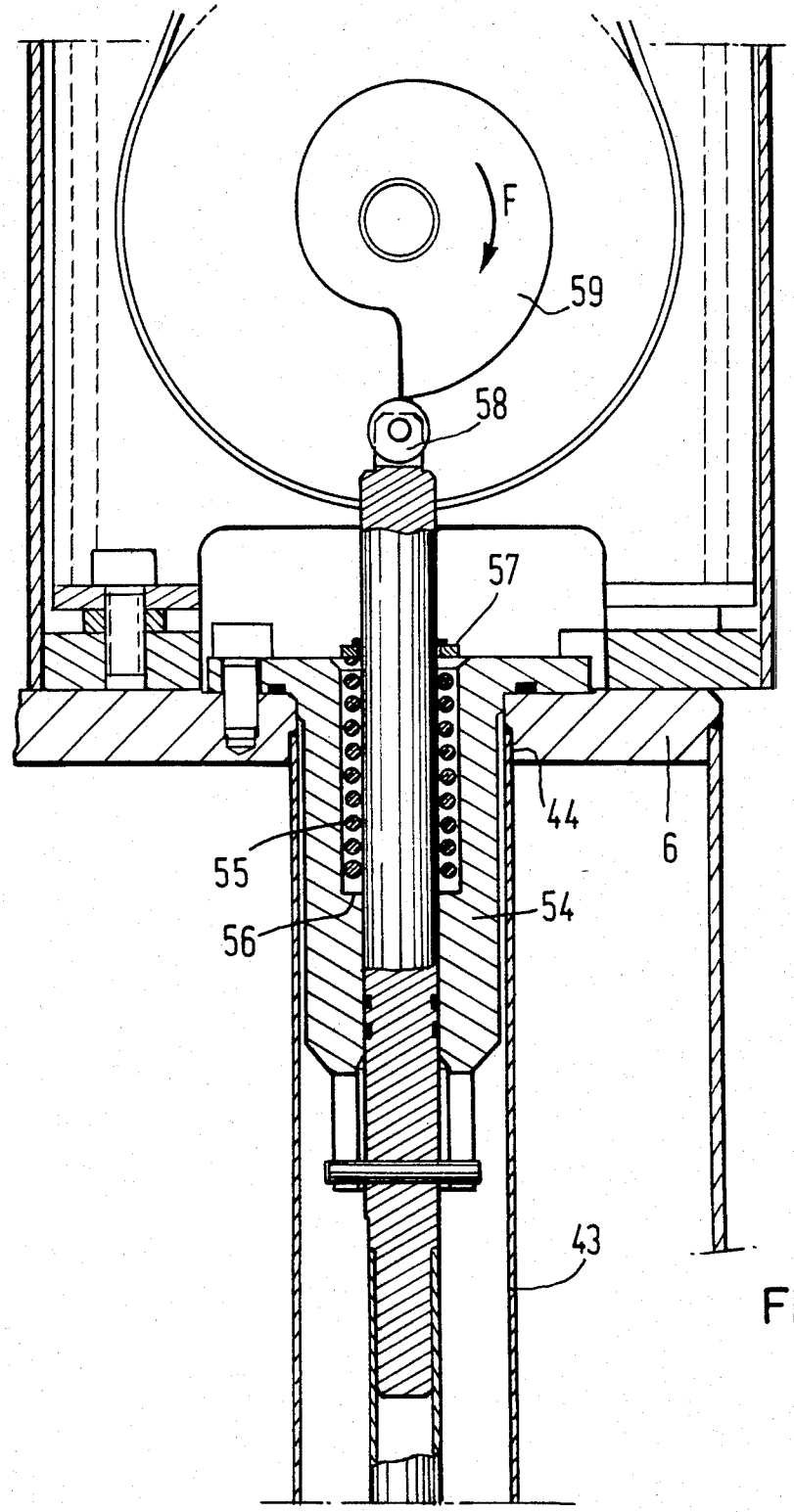

With reference to FIGS. 1 to 5, a cryogenic liquid distributing device according to the invention comprises a reservoir 1 formed by a reservoir body 2 and a slightly eccentric cover 3. The reservoir body 1 and the cover 3 are both highly insulated and, for this purpose, the reservoir body 2 is formed by double lateral walls 4–5 interconnected by an upper annular plate 6 and a double bottom 7 and 8. The cover 3 is also formed with a double thermal insulation wall and includes a degasing tube 12. For this purpose, the cover 3 has an upper plate 13 with a large passage 14 and an eccentric passage 15, the axial passage 14 being provided for the passage of the degasing tube 12, while the eccentric passage 15 is provided for the cryogenic liquid inlet tube 11. Welded to the upper plate 13 is an annular skirt of an outer lateral wall 17 which is extended by a bottom 18. Welded in the region of the eccentric passage 15 is the end of a tube 23 which forms the outer part of the supply pipe 11 and surrounds a central tube 24 for the cryogenic liquid whose outer end is provided with a coupling 25 and which extends through the thickness of the cover 3 and communicates through the bottom wall 18 with the region of a seat 32 of a valve 31 whose valve member 30 is carried by a vertical control rod 33, this control rod 33 being mounted in a support arm 34 connected to a float 35. The float 35 is freely vertically slidably mounted on a vertical shaft 36 fixed at an upper end to a support plate 37 connected to the bottom wall 18 of the cover 3. Mounted between the float 35 and a support ring 38 connected to the lower end of the shaft 36 is a compression spring 39 which only partly compensates for the weight of the float 35.

The bottom plate 8 of the inner reservoir 9 is provided with an orifice 40 to which is welded a bent drawing-off tube 41 which extends horizontally, with an expansion joint 42, to a region located in vertical alignment with a part of large radial size of the space between the walls 4 and 5 of the reservoir body 2. In this region, the drawing-off tube 41 opens into a vertical sleeve 43 which extends throughout the height of the lateral walls 4–5 of the reservoir body 2 and is secured at its upper end to an eccentric orifice 44 of the upper plate 6. At its lower end, the sleeve 43 includes a seat 44*a* of a valve 45 which communicates with a drawing-off end member 46 having an expansion joint 47 and extending through the space between the bottom walls 7–8 to an outer coupling 48. The seat 44 of the valve 45 cooperates with a valve member 50 mounted by means of a spring 51 on the end of a rod 52 which is axially slidably mounted in the sleeve 43 and extends through the wall 6. The rod 52 is biased on the outside by a compression spring 55 mounted between a lower shoulder 56 of the junction 54 and an upper flange 57. This valve rod 52 cooperates through a roller 58 with a cam 59 driven in rotation by an electric motor (not shown). In the position shown in FIGS. 1 and 4, the cam 59 is in the position of maximum action on the rod 52 which is in the lowermost position and puts the valve member 50 in closing contact with the seat 44, the small variations due to expansion being compensated for by the spring 51.

As can be seen, the rotation of the motor which drives the cam causes the latter to rotate in the direction of arrow F and thus results in a gradual rising of the valve rod 52 and consequently in a corresponding opening of the valve 45.

Figure 5:
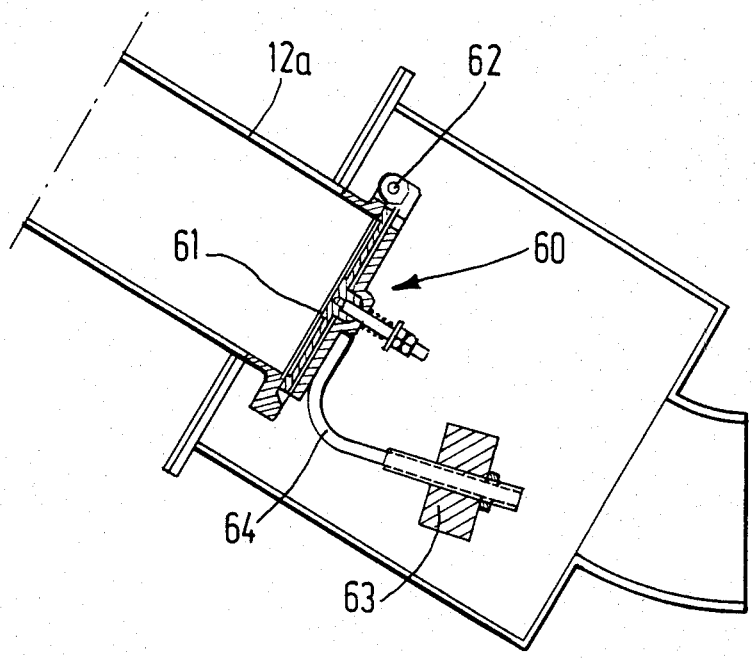

With reference more particularly to FIG. 5, it can be seen that the degasing tube 9 is here provided at its bent outer end 12*a* with a valve 60 comprising a flap 61 which is pivotally mounted on a pin 62 and subjected to the action of a counterweight 63 adjustable in position on a bent rod 64, the arrangement being such that, in the absence of a pressure higher than atmospheric pressure in the degasing pipe 12, the flap 61 is in its closing position.

On the other hand, if a pressure is developed inside the degasing pipe 12, the flap 61 tends to be opened under the effect of this pressure, by rotation about the pin 62, and the moment of this opening may be regulated by adjusting the position of the counterweight 63 along the rod 64.

Figure 6:
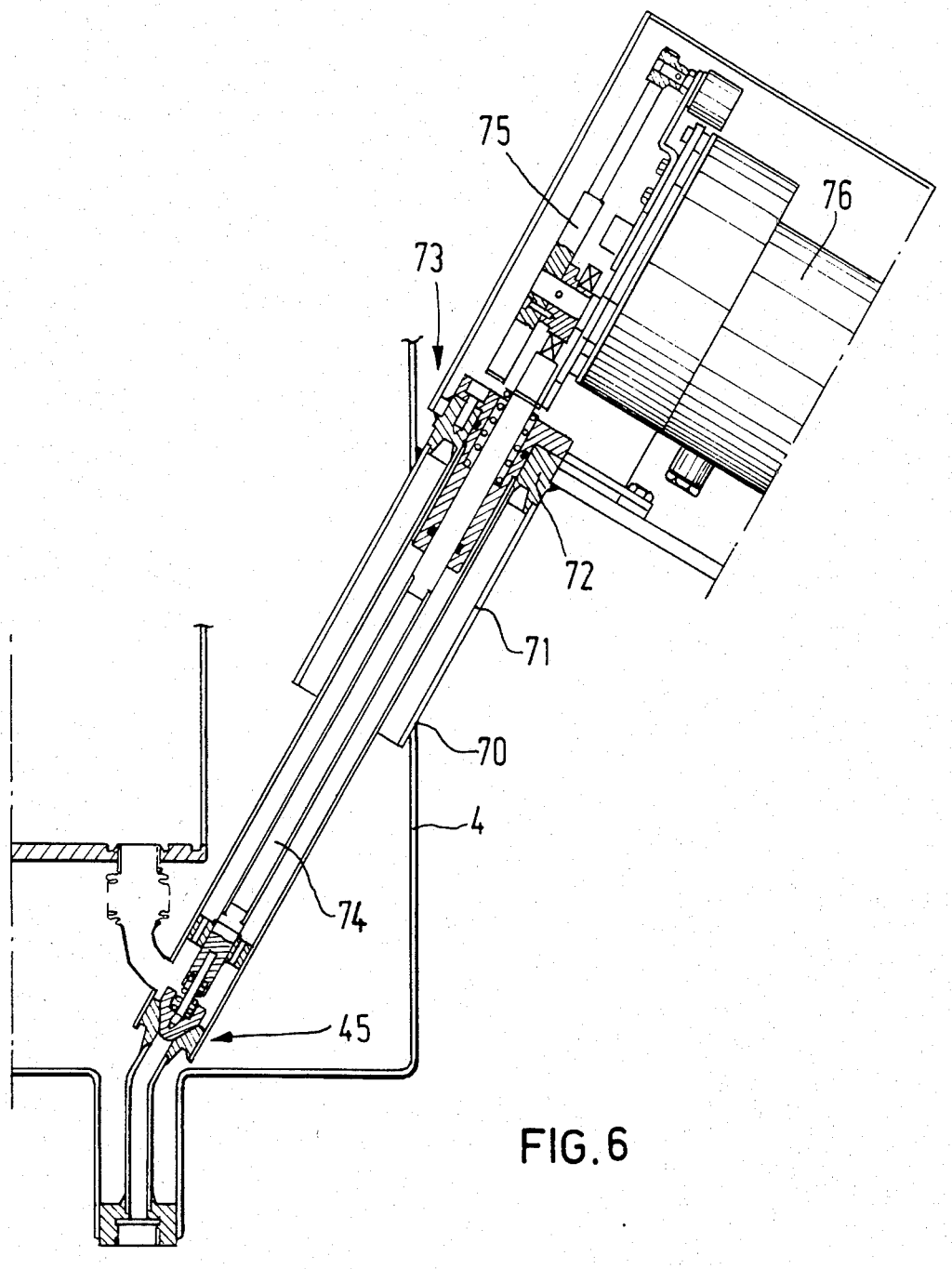
FIG. 6 is a view similar to FIG. 1 of a modification.

The modification shown in FIG. 6 differs from the foregoing embodiment in that, for reasons of size, the means for actuating the drawing-off valve 45 are inclined to the vertical and no longer extend through the plate 6 but through the lateral wall 4. For this purpose, there is welded within an elliptical opening 70 a sleeve 71 with an upper end wall 72 which acts as a support for the control means 73 having a rod 74 shifted by a cam 75 and an electric motor 76.

The invention is applicable to the delivery of relatively low flows of liquified gases, for example nitrogen or argon, for rendering molten metals, and in particular pouring jets, inert.

What is claimed is:

1. A cryogenic liquid distributing device comprising a reservoir which has two spaced-apart walls constituting a double wall which highly insulates the reservoir, said two walls defining an interstitial insulation space in which insulating particles are disposed and constituting an inner reservoir body and an outer case, an inlet pipe and a lower drawing-off pipe both opening into said reservoir body, said drawing-off pipe having a drawing-off valve in said interstitial space, and means for regulating the utilization flow of said liquid including a control rod which extends in said interstitial insulation space and operates said drawing-off valve, said outer case defining a fluidtight passage through which said control rod extends, said control rod extending beside said reservoir body on the side of said reservoir body and between said reservoir body and the portion of said case which is closest to said reservoir body on said one side of said reservoir body.

2. A distributing device according to claim 1, wherein the reservoir has a cover having two spaced-apart walls defining a double insulation wall, and a degasing pipe extends through said cover and has an outer end portion which is bent downwardly and a degasing valve is provided in said outer end portion and includes a valve opening flap and a counterweight combined with said flap so as to adjust the opening of said flap.

3. A distributing device according to claim 2, wherein said cover is provided with means defining a passage, said inlet pipe for the cryogenic liquid having an inner tube for conveying said liquid and an outer wall spaced from said inner tube and defining a double wall, said inner tube extending through said passage in said cover and said outer wall being welded to an outer wall of said two spaced-apart walls defining a double insulation wall of said cover.

4. A distributing device according to claim 3, and constant-level regulating means including a float, a longitudinally-extending rod connected to an inner wall of said two spaced-apart walls of said cover, said float being slidably mounted on said rod, an arm carried by said float, a valve member combined with said arm and cooperative with a valve seat, which valve member and valve seat are part of said inlet valve which is provided at an end of said inner tube of said inlet pipe for the cryogenic liquid.

5. A distributing device according to claim 2, and constant-level regulating means including a float, a longitudinally-extending rod connected to an inner wall of said two spaced-apart walls of said cover, said float being slidably mounted on said rod, an arm carried by said float, a valve member combined with said arm and cooperative with a valve seat, which valve member and valve seat are part of said inlet valve which is provided at an end of said inlet pipe.

6. A distributing device according to claim 1, wherein said drawing-off valve is placed in a low position and said fluidtight passage is located in an upper part of said case.

7. A distributing device according to claim 1, wherein said drawing-off valve is placed in a low position and said fluidtight passage is a lateral passage in said outer case.

* * * * *